US007937852B1

(12) United States Patent
Krehbiel

(10) Patent No.: US 7,937,852 B1
(45) Date of Patent: May 10, 2011

(54) FLEXIBLE FOOTWEAR COVER

(76) Inventor: James K. Krehbiel, Colorado Springs, CO (US)

( * ) Notice: Subject to any disclaimer, the term of this patent is extended or adjusted under 35 U.S.C. 154(b) by 614 days.

(21) Appl. No.: 12/010,474

(22) Filed: Jan. 25, 2008

(51) Int. Cl.
*A41D 17/00* (2006.01)
*A41D 17/02* (2006.01)

(52) U.S. Cl. ..... 36/2 R; 2/22; 2/920; D29/121.2; D29/119; D2/970

(58) Field of Classification Search ..... 36/1.5, 36/2 R, 136, 132; D29/119, 122, 121.2; D2/970; 2/22, 911, 920; 12/128 D
See application file for complete search history.

(56) References Cited

U.S. PATENT DOCUMENTS

| | | | | |
|---|---|---|---|---|
| 1,712,035 | A * | 5/1929 | Frykman | 36/1.5 |
| 2,230,291 | A | 12/1939 | Evans | |
| 2,872,745 | A | 8/1956 | Finegan | |
| 3,083,373 | A * | 4/1963 | Rizzotto | 2/270 |
| 3,153,864 | A | 10/1964 | Brewer | |
| 3,238,537 | A | 3/1966 | Fowler et al. | |
| 4,219,945 | A | 9/1980 | Rudy | |
| 4,601,066 | A | 7/1986 | Campbell | |
| 4,713,895 | A | 12/1987 | Vallieries | |
| 4,896,437 | A | 1/1990 | Johnson | |
| 5,170,503 | A * | 12/1992 | Hightower et al. | 2/22 |
| 5,172,493 | A | 12/1992 | Diaz | |
| 6,131,194 | A * | 10/2000 | Ardura Gonzalez | 2/22 |
| 6,477,788 | B1 * | 11/2002 | Chen | 36/1.5 |
| 6,490,736 | B2 | 12/2002 | Phillips | |
| 6,553,578 | B2 | 4/2003 | Phillips | |
| 7,465,284 | B2 * | 12/2008 | Huppert | 602/65 |
| 2004/0158187 | A1 * | 8/2004 | Huppert | 602/65 |
| 2007/0049857 | A1 * | 3/2007 | Quinn et al. | 602/27 |

OTHER PUBLICATIONS

C. Weiss, Dirty Girl Gaiters, Run like a dirty girl!, http://www.dirtygirlgaiters.com, Page Downloaded Jan. 10, 2008.

* cited by examiner

*Primary Examiner* — Jila M Mohandesi
(74) *Attorney, Agent, or Firm* — Donald Grant Kelly

(57) ABSTRACT

A flexible, elastic gaiter device designed to doubly encircle an upper rim of a wearer's footwear as well as the wearer's ankle to block ingress of debris into the footwear upper rim while bracing wearer's ankle protecting it against external and internal injury. The device is an elongated generally rectangular article. It comprises a closed loop nylon plush fabric outer layer to which is foamed an inner layer of synthetic rubber based on polychloroprene. At one end of the article's rubbery layer a fastener strip of hook elements is attached. The gaiter device is applied with its rubbery layer bridging the footwear upper rim, and firmly stretched to a double wrap, then secured by fastening the strip of hook elements with the plush outer layer. Lower edge corners of the article are diagonally cropped so that, when stretched, the lower edge will not have unsightly exposed portions.

6 Claims, 4 Drawing Sheets

FLEXIBLE FOOTWEAR COVER

REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING

Not applicable.

BACKGROUND OF THE INVENTION

1. Field of the Invention

The present invention relates to footwear and more particularly to gaiter-type devices for covering lower extremities and boots or shoes against ingress of snow, water or unwanted debris.

2. Description of the Related Art

Gaiters have been used for centuries as items of clothing worn to protect the wearer from the elements. Today, the gaiter name is given to any of a variety of accessories for covering various parts of a wearer's body from the neck to the feet. Gaiters have a long history as military uniform accessories and often are found as protective fashion wear and sportswear. A typical gaiter associated with footwear can be found in the form of fabric attachments to fishing waders or for hiking boots and running shoes worn in sandy, snowy or muddy environs. Increasingly, varied gaiter devices appear as standard gear for skiers and snowboard enthusiasts attempting to keep snow from packing into the top openings of their boots. Gaiter devices generally are configured to attach in some manner to the footwear (shoe or boot), as by hook and loop fasteners (trade name VELCRO®), hook and eye fasteners, snaps, buttons, zippers, anchor straps, laces or other means.

Typical gaiter devices may be fabricated of leather, plastic, canvas or other well known materials. They may be relatively brief or short, for example to barely cover an upper surface of a shoe. On the other hand, footwear gaiter devices may reach as high as the knee, or even higher in the case of waders. In all known cases, gaiters serve the purposes of guarding against the entrance of unwanted materials around the wearers feet and/or keeping the wearer's lower extremities warm and dry. Some are designed merely to protect against scuffing the upper surface of the shoe or boot. The following are patented (or patent pending) devices of interest relative to the present invention.

Chen's U.S. Pat. No. 6,477,788 presents a specially designed sports shoe with a footwear-encompassing gaiter device interconnected at its ends by attached hook and loop fastener panels. Chen's gaiter surrounds the sport shoe and is directly, rigidly interconnected to the shoe by a concealed zipper device affixed at the top of the shoe upper. The Chen gaiter device is constructed of material such as polyvinyl chloride, polyurethane or a fabric and is presented as encompassing the wearer's shoe and ankle only once. The precise extent of the Chen gaiter about the wearer's leg is predetermined, not only by the affixed zipper mechanism but also by the location of cooperating hook and loop fastener panels at facing ends of the gaiter. In other words, the Chen gaiter will have a constant circumferential reach even when zippered to other shoes. The Chen device is for keeping pebbles and such from entering the sports shoe and is not disclosed as having utility apart from this custom designed shoe configuration.

U.S. Pat. No. 4,601,066, issued to Campbell, shows a fashion/exercise garment which includes warming wraps in the form of elongated bindings secured by hook and loop fastener sections. There is no disclosure of application to prevent injury or to guard against entry of debris. In other words, Campbell is silent as to any use for bracing and ankle joint against injury (internal or external), nor is there any mention of use for addressing rough or debris littered terrain. Finegan, in U.S. Pat. No. 2,872,745, shows a spat-type shoe cover where the upper portion is wrapped once about the user's ankle and leg, and terminates at a fixed circumference about the wearer's limb. The wrapping extent is predetermined by placement of rigid clasps. Only the very lower portion of Finegan's shoe cover includes an inner lining of foam rubber. To hold the Finegan cover in place the lower portion of the spat includes a strap affixed beneath the shoe sole.

Vallieries also was granted U.S. Pat. No. 4,713,895 for a shoe cover for sports shoes. This cover arrangement includes a first flexible sheet portion completely covering the shoe upper and heel portion of a sports shoe. Attached to the first flexible sheet portion by means of hook and loop fasteners (spaced to provide air circulation) is a second flexible sheet portion covering the ankle and lower calf of the wearer. Hook and loop fasteners (e.g., VELCRO® fasteners) disposed along the shoe sole, hook and loop fasteners serve to affix the second sheet portion directly to the shoe. The sheet portion disposed about the ankle includes a pleated portion to accommodate differences in leg size while an additional hook and loop fastener strip is positioned at the shoe cover top opening so as to close the upper fold.

Johnson's U.S. Pat. No. 4,896,437 shows a gaiter and bootie foot cover combination. The gaiter is a rectangular wrap with a removable insulating, waterproof liner affixed to the bootie by strips which may comprise hook and loop (VELCRO®) fasteners. The Johnson bootie-gaiter is joined together by vertical zipper elements and snaps which determine the extent of the circumferential wrap, and further employs a holding strap fastened beneath the boot sole.

In U.S. Pat. No. 3,153,864, Brewer presents a robust protective garment that provides full wrap-around protection in the form of a legging. The garment is generally rigid and requires an inner support frame. Again, the extent of the wrapping (in terms of tightening or loosening by the wearer) is wholly dictated by the legging fasteners positioned at a rear garment seam.

Evans, in U.S. Pat. No. 2,230,291, illustrates a hollow legging fastened directly to a rubber shoe cover. Both are waterproof and are pre-sized in terms of their extent about the foot and leg. The Evans legging is stretchable about the leg and ankle but is fixed to the shoe at predetermined points and terminates in a vertical zipper. There is no indication that the Evans device can be wrapped more or less tightly than allowed by the predetermined shoe attachment placement.

Diaz's U.S. Pat. No. 5,172,493 illustrates a safety cover for shoes, boots and the like where the cover comprises an inner layer and outer layer of durable fabric, and including a lining of woven and non-woven aramid fiber fabric therebetween. Patentees Fowler et al. illustrate in their U.S. Pat. No. 3,238,537 a single wrap ankle warmer secured by a hook and eye arrangement, and perceived as more fashionable than functional. Rudy's footwear patent (U.S. Pat. No. 4,219,945) discusses shoe structure material composition options as including Neoprene®, polyvinyl chloride and polyurethane in shoe parts in the context of shoe-sole loads and rebound qualities.

Apart from the above-discussed patent-focused activity, Internet-based web site vendors offer a variety of footwear accessories in the form of gaiter or gaiter-type devices for avoiding entry into boots or shoes by snow, dirt, sand, rocks, mud and pebbles. For example, water resistant leggings from Knee-Necks, LLC are offered under the trademark KNEE-NECKS™. These leggings cover the user from knees to ankles. Each legging unit is custom quilted and sized such that the ends encircle the lower leg to a predetermined extent. The encircling ends include matching strips of hook & loop fasteners (e.g., Velcro® fasteners).

Another commercial product of the gaiter type is offered as DirtyGirlGaiters sold by Zombie Runner under the trademark DirtyGirlGaiters™ and includes stretch Spandex® material with a mechanical hook configured to affix the device at a front shoelace of a running shoe. This device is then drawn toward the rear or heel of the shoe where matching strips of hook and loop attachments (e.g., Velcro® fasteners) complete the shoe interconnection, again at predetermined locations. Typical of Internet-based web site retail sites, the descriptions and depictions are un-dated.

The technologies mentioned hereabove are presented only as general background information and in no way as admission of applicable prior art relative to the invention claimed herein. Reviewing previous gaiter-related prior technologies, it is particularly notable that none enjoys the multiple features and advantages provided by the present invention. All suffer from one or more of the following shortcomings. For example, the applicability of most gaiter type devices, in terms of manually-adjusted tightness, is limited by design to predetermined collaborative design features. For example, they have been configured to encircle the wearer's lower leg and/or shoe top only to predetermined points of mechanical connection, except for some devices with slightly adjustable top closures. In general, they are not adjustable throughout their extent of application to the user's foot and ankle to afford important bracing support and overall, conforming tightness as an effective barrier to debris and water.

Also, in most configurations, the preexisting gaiter devices are mounted only through a user's tiring exertion of considerable dexterity during extended periods of back-bending strain. Another shortcoming with previous wraps of the gaiter type is that they generally are designed to encircle the leg or ankle only once before terminating at a determined fastener placement location (e.g., clasp, zipper, or other connection device) resulting in a loose covering of single thickness.

Currently available gaiter devices lack durability in that they frequently include design features such as tiny hooks, tabs, under-sole straps, and zippers prone to structural failure in rugged outdoor working environs or rigorous sports settings. Even if the prior art fasteners were more durable, they typically are cumbersome and limit users' mobility. Besides that, more complexly detailed gaiter structures with interconnection details and such are expensive to manufacture since their fabrication and assembly call for skilled laborers working with relatively expensive specialty metal or high impact plastic parts.

Dimensions of known gaiter devises and the location of their attachment elements limit their ability to adequately "fit" the ankle and boot top area in the effective manner offered by the present invention. They also lack comfort and aesthetic appeal. Beyond that, most are not conveniently storable between uses, for example, simply rolled into a coat pocket or glove compartment.

Finally, and importantly, existing gaiter-type devices do nothing to firmly brace a wearer's complex ankle joint and its supporting ligaments against twisting or turning on rough terrain, nor do they help guard against costly injury from heavy or sharp rocks, encounters with construction equipment and the like. The present invention, on the other hand, is an elegantly simple but clever configuration thoughtfully designed to effectively address all of the above-noted shortcomings. Moreover, it does so in an expensive and stylish manner.

Disclosed herein are inventive gaiter devices and their method of use which are, by design, exceptionally effective, durable and long-lasting. They are easily applied in seconds and are universally applicable to any size ankle or any mid-top work, hiking, basketball or running shoes. The inventive gaiter devices function without requirement for footwear-based attachment features. Use of the devices requires no special training. Manufacture of the inventive gaiter devices commands no special machining skills. The inventive gaiter devices can be inexpensively packaged, stocked and shipped. They enjoy a clean aesthetic appearance and require minimal dexterity or back-bending effort in their application. They can be readily cleaned by hand or automated washer, using water or soapy water, and between uses are conveniently storable (e.g., in a pocket or glove compartment).

The present invention is elegantly simple to make and use and, importantly, enjoys universal applicability to any ankle/boot size and in combination with any type of footwear without requiring provision of mutually interconnecting fasteners (between gaiter and footwear). The foam skin inner surface, to be described herebelow, with its high coefficient of friction, affords traction in gripping the surface of the boot or shoe with a traction that resists upward creep when worn.

Clearly setting it apart from all known prior art gaiter type devices, the present invention's strategically doubled layers, constructed and configured as will be described more in detail herebelow, delivers a number of advantages. The inventive devices and their method of application effectively and continuously prevent ingress of unwanted debris and the like (in this context, including snow, water and solid particulates), while also offering considerable warmth to the wearer. The foam-backed fabric of the inventive devices, absent any attachment devices other than its own self hook and loop engagement, can be elastically stretched tightly in a protective double layer and firmly secured about the footwear top edge. Entry of annoying and injurious debris, snow and water is decisively prevented. Moreover, whether the footwear is mid-top or low-top, the wearer's ankle is protected from outside injury by sharp stones and other objects as well as internal injury through painful twisting on rugged, rocky landscapes and shifting sand.

BRIEF DESCRIPTION OF THE SEVERAL VIEWS OF THE DRAWINGS

The invention will be best understood by reference to the following detailed description of an illustrative embodiment when read in conjunction with the accompanying drawings, wherein.

DETAILED DESCRIPTION OF THE INVENTION

Figure 1:
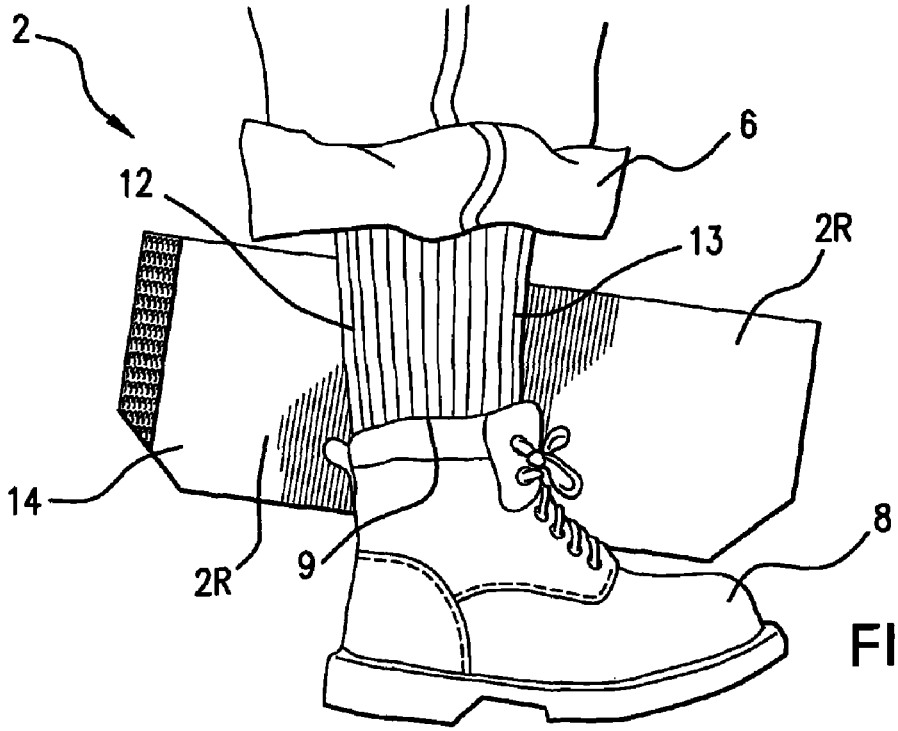
FIG. 1 illustrates a side elevation of a typical (right) work boot, prepared for wrapping by an inventive gaiter device shown adjacent thereto prior to application.

As viewed in FIG. 1, footwear is illustrated in the form of a mid-top work boot 8 (as an example of footwear to which the invention may apply) typically worn over at least one layer of sock 12 within wearer's trousers 6 depicted on wearer's leg 13. Application of the present invention usually begins by lifting or rolling-up a leg of trousers 6 as shown in FIGS. 1-5. This exposes the target area demanding snug gaiter coverage, namely upper rim 9 of work boot 8 terminating where sock 12 emerges therefrom. This is the critical zone for which an effective barrier to unwanted debris, particulates and water is to be formed.

By way of demonstration, of the inventive device and its method of use, gaiter 2R is described herein as configured for the "right" work boot 8. The importance of this protocol will become apparent in due course. The compositional makeup of the gaiter 2 also is important.

Figure 2:
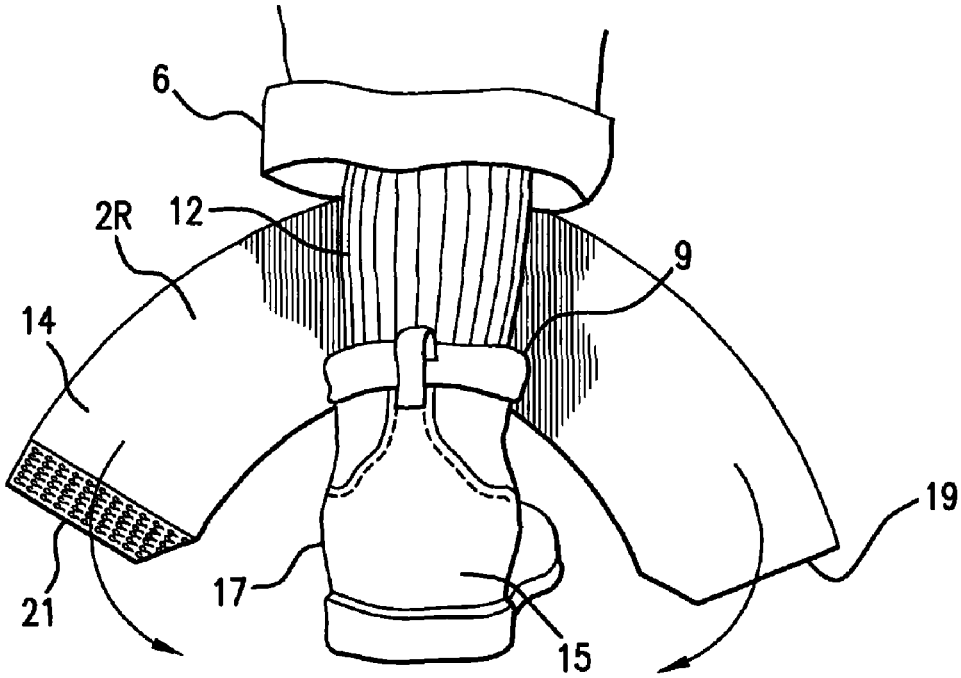
FIG. 2 illustrates a rear elevation of the work boot of FIG. 1 as the inventive gaiter device is readied for application.

Gaiter device 2R is shown in starting position in FIG. 2, directly applied to boot 8 top rim 9 and approaching from the front (e.g., lace closure area) of boot 8. Gaiter device 2R terminal end edges 19 and 21 are drawn toward boot 8 sides 15 and 17, respectively. (Note that side 17 is the instep side of boot 8). Gaiter device 2R has a first (inner) side layer 14 which comprises a relatively smooth rubbery surface. The term "rubbery" in this context is intended as meaning "of or resembling rubber" and including material (rubber or artificial rubber and the like) which is resilient, durable, waterproof, and elastically stretchable with significant material memory tending to return it to its initial shape after being subjected to stretching action.

Rubbery side layer 14 of device 2 also has a gripping traction characteristic of rubber and the like, particularly when drawn against leather, textile, canvas, or other rubbery surfaces. For example, this layer 14 may comprise a foamed elastomeric product known as Neoprene®.

Gaiter device 2R has a second (outer) side layer 16 which embodies a textile unbroken loop fabric to which skin surface layer 14 is directly "foamed." Of course, the skin surface layer 14 could be foamed and subsequently affixed to layer 16 by a suitably flexible adhesive. Terminal end 21 of side layer 14 is equipped with a fastener element 18 (FIG. 6) embodied as a strip of "hook fastener" typically associated with hook and loop fasteners (e.g., VELCRO® fasteners) of the type discussed hereabove. The hook fastener strip element 18 is illustrated as affixed to the rubbery side 14 by stitches 28 (or equivalent attachment means such as glue, staples, brads or heat fusion).

Figure 3:
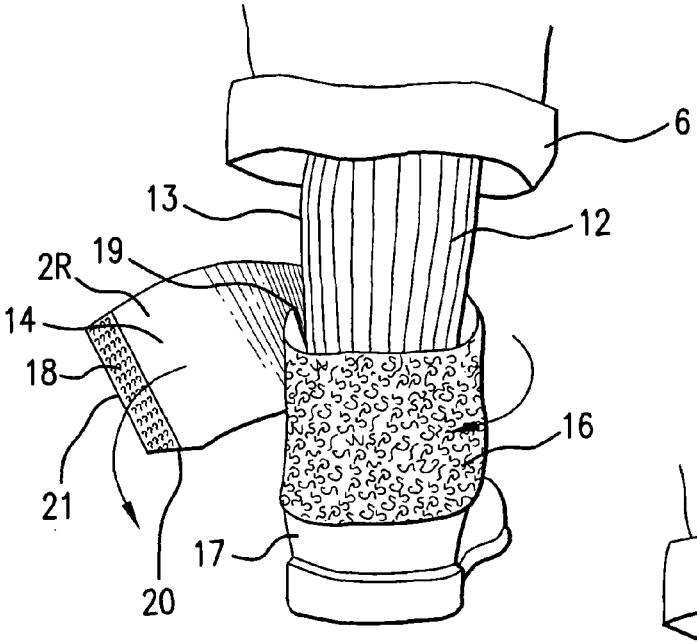
FIG. 3 is another rear elevation similar to FIG. 2 and showing the inventive gaiter device initially wrapped about an outer side of the work boot.
Figure 4:
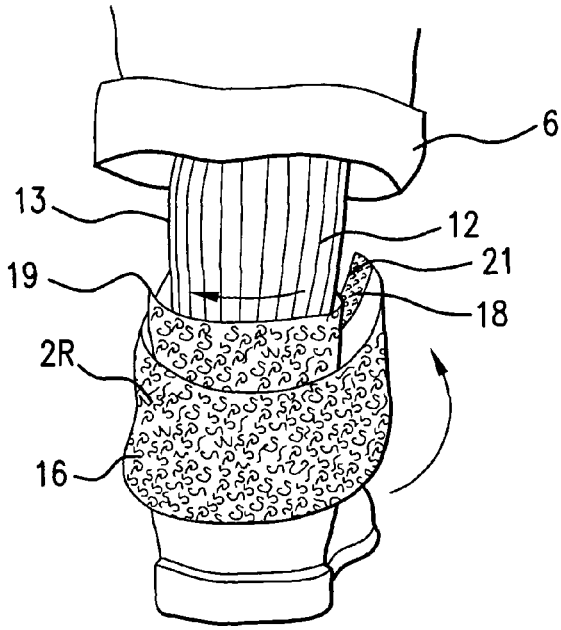
FIG. 4 is yet another rear elevation similar to FIGS. 2 and 3 illustrating the present gaiter device invention almost fully applied.

As the gaiter device 2R is firmly drawn and forcibly stretched about boot rim 9, with rubbery side layer 14 frictionally engaging boot sides 15 and 17, end 19 of device 2R is pulled and forced beneath overlapping end 21 (FIG. 3). Meanwhile, end 21 and its associated fastener element 18 are pulled or drawn until device 2R is formed into a tight protective double layer about boot 8 (FIG. 4). At its (desired) stretched extent, end 21 is fastened in place (FIG. 5) as hook strip fastener element 18 is pressed to interconnect with closed loop layer 16. Note that a lower edge of layer 16, though diagonally cropped at 20 (as will be further discussed herebelow), will be stretched into a generally even alignment such that no excess flaps or corners are exposed at a lower edge of the gaiter device.

Figure 5:
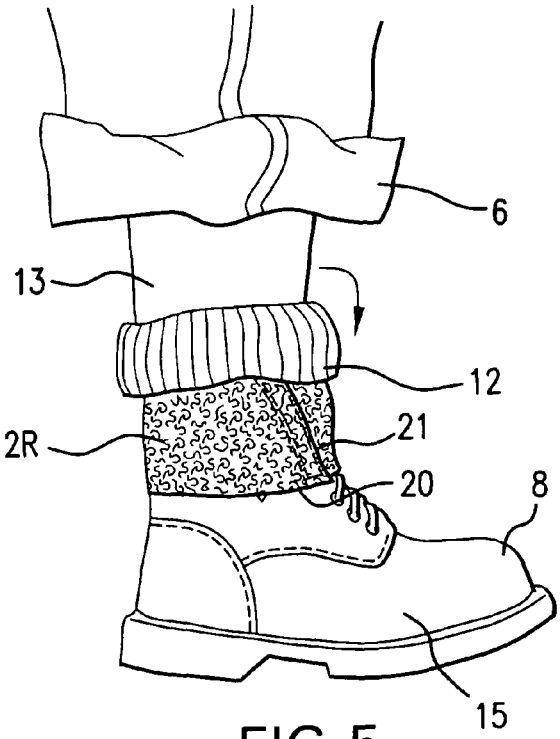
FIG. 5 is another side elevation of the work boot similar to FIG. 1, but with the present gaiter device invention stretched and fastened in place.

The present gaiter device is fabricated to stretch to an extent that ranges 125% to 140% of its initial length. At its most stretched extent (to a gaiter tightness determined by the user), fastener element 18 is then fixedly engaged to an opposing (unbroken loop textile) fabric side 16 (FIG. 4). The frictional interface of boot 8 with rubbery side 14 of gaiter device 2R will help to retain the layers in place during even the most rigorous movement. As depicted in FIG. 5, subsequent to attachment of hook strip element 18, wearer's sock 12 may be folded downwardly over an uppermost edge of the wrapped gaiter device 2R, and trouser leg 6 unrolled (not shown).

Figure 6:
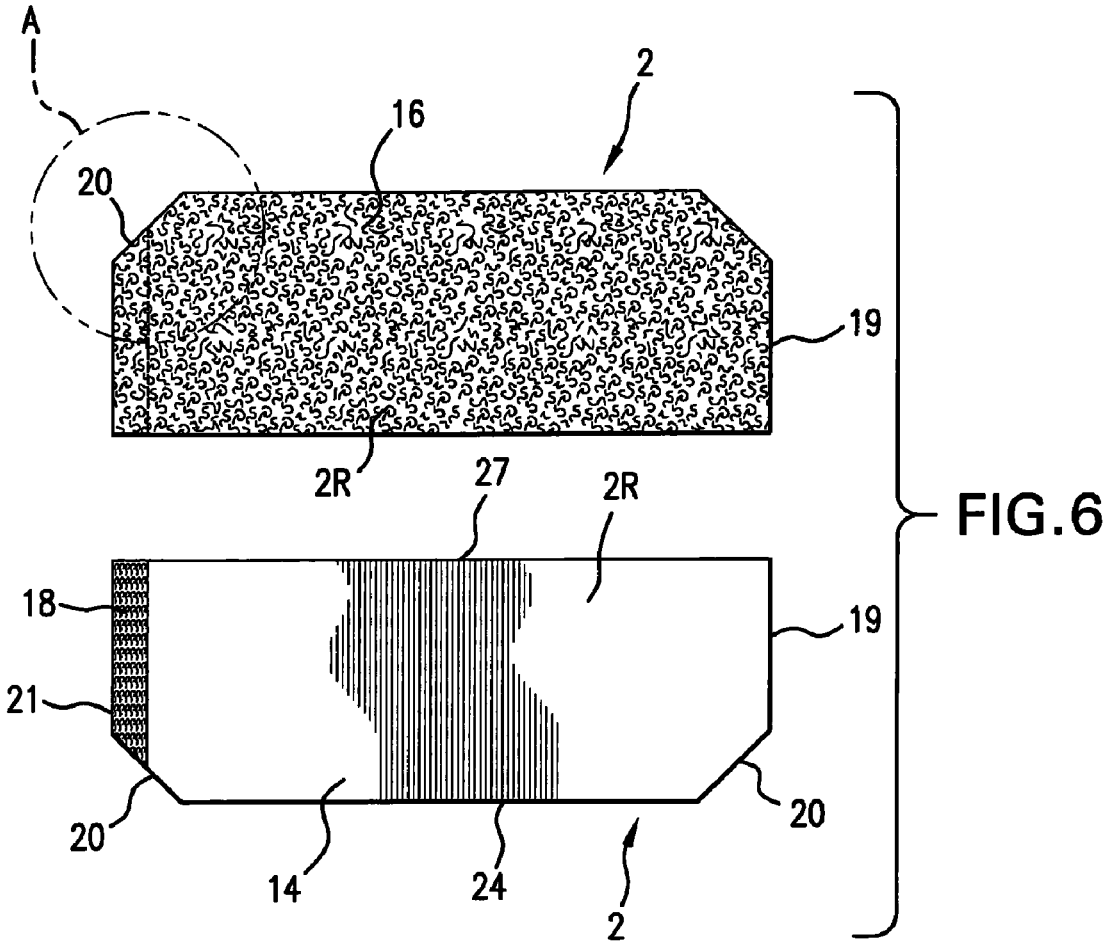
FIG. 6 is a plan view of both an obverse and a reverse side of one of the gaiter devices, in the instance shown the device depicted is configured for application to a "right" shoe/boot.
Figure 7:
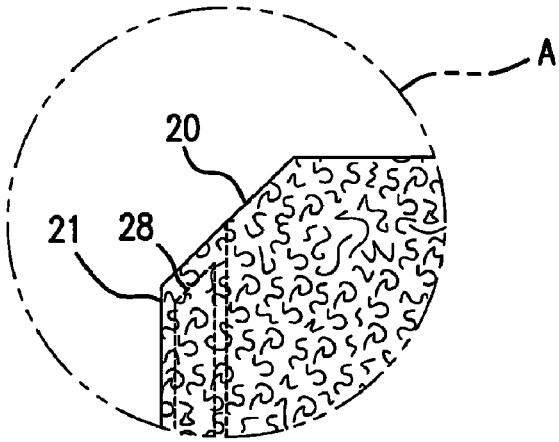
FIG. 7 is an enlarged view of a portion of FIG. 6 indicated by circle A.

Illustrated in FIG. 7 is a detailed view of end 21 of the closed loop material 16 of gaiter device 2 (see detail A taken from FIG. 6). Hidden in this view (FIG. 7) but defined by dash lines, fastening element 18 is depicted as secured on the rubbery skin side 14 by stitching 28. Fastening element 18 could of course be interconnected to device 2 by any of a variety of equivalent means such as adhesive, heat bond, staples, and so on.

Again, the above step-by-step description of the device 2R and its application was specifically for a "right" boot/shoe 8 and is one of a pair of inventive gaiter devices 2. The inventive gaiter device 2L and its method of application to a "left" boot/shoe (not shown) are essentially the same as for device 2R. However, gaiter device 2L is preferably configured as opposite (as in mirror image) to device 2R and applied in an opposite wrapping direction.

Figure 8:
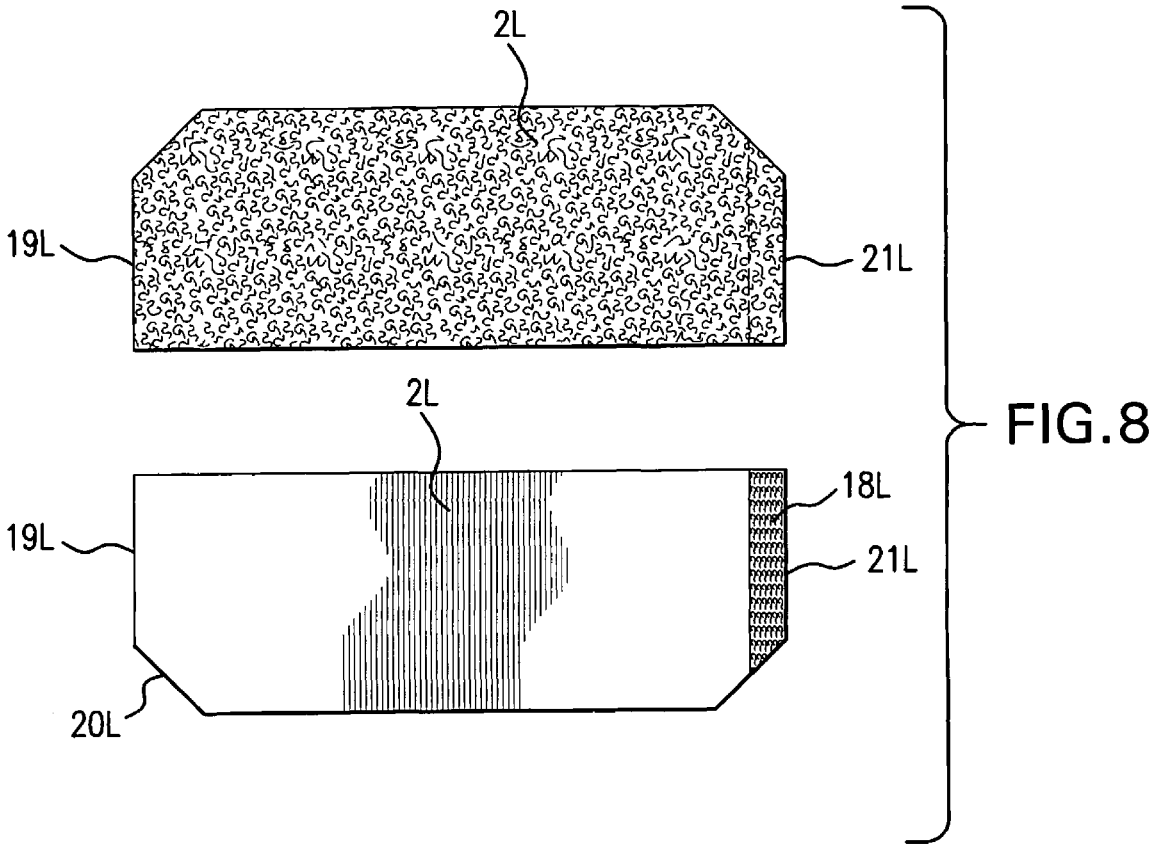
FIG. 8 is a plan view of both sides of an inventive gaiter device appropriately configured for a "left" work shoe/boot.

FIG. 8 shows the configuration of gaiter device 2L. When applying device 2L from the boot-front in the manner with which device 2R was applied, the end 21L having the fastening element 18L begins on the instep side of the "left" boot/shoe 8 and is stretched around to a fastening area as described above.

It is important to note that the length of wrapping path or extent of both gaiter device 2R and 2L is naturally slightly less along its first or upper edge designated in FIG. 6 as 27, as compared to the extent of wrapping path along its second or lower edge 24 of gaiter devices 2R, 2L. If device 2R/2L were to be generally rectangular, this discrepancy would result in an unwelcome ragged lower edge 24 (shown as relatively smooth in FIG. 6) where corners at the ends of lower edge 24 would protrude when fully wrapped. This would be detrimental to aesthetic appearance of the wrapped gaiter device 2, and the protruding corners would present possible snag points bound to become frayed, tattered, and eventually require replacement.

To avoid the problem of unwanted snag points the corners at the ends of elongated lower edge 24 are diagonally pre-trimmed or truncated to form cropped corners 20. Thus, in its un-stretched condition, the second or lower elongated edge 24 is formed so as to include diagonally directed end portions thereof respectively interconnecting first and second end edges 19, 21 at an obtuse angle so as to form therewith diagonally. However, when the inventive gaiter device is in its stretched and fastened condition, the diagonally cropped corner stretches to a point where it substantially aligns with the elongated lower edge to form a relatively smooth edge when applied to said footwear.

While not necessarily recommended, inventive gaiter wrap devices 2R, 2L also may be applied beginning at a rear portion of boot/shoe 8 along upper rim 9, then passed about the front of the boot/shoe 8 and returned in a double layer and fastened at or near the rear boot/shoe 8 portion. The gaiter devices 2R, 2L may also be applied from other directions and from other starting points with similar results.

For best results, however, it is important that, in every case, end 21 with fastener element 18 of each gaiter device 2R, 2L always terminates somewhere on the outer side surface 15, i.e., between toe and heel midpoints (for either right or left shoe/boot). This protocol will serve to avoid accidental and perhaps hazardous interference between interfacing fasteners 18 at instep sides 17. Of course, the lower edges 24 with cropped corners 20 should, in every instance, be oriented downwardly toward the ground or floor (not shown, but obviously beneath the sole of boot/shoe 8).

As discussed above, inventive gaiter devices 2 comprise relatively soft loop fabric material 16 with an elastomeric backing 14. Such elastomers should be relatively soft, pliable and flexible, as well as suitably stretchable with memory. By way of example, while other materials may be satisfactory, highly successful results have been achieved with Neoprene® which is a DuPont Corporation synthetic rubber based on polychloroprene. Such material is commonly found in the construction of wetsuits, laptop covers, auto fan belts, gaskets, hoses and a variety of other applications.

Excellent prototypes of the present invention have been constructed from stock fabric material carrying the trade name LoopTex®. This material is commercially available, for example, from Macro International Company of Irvine, Calif. and is referred to in the trade as "LoopTex on Skin." This particular stock material comprises a foamed Neoprene backing in the range of about 0.5 to 3.5 mm thickness Neoprene® intimately covered on one side by a layered fabric comprising relatively short unbroken (closed) loops or nylon plush.

Merely as a working example of the inventive gaiter devices, a current prototype is fabricated so as to be generally suitable for an adult wearer wherein the device shape and dimensions are approximately as follows: 18 inches in length (on lateral sides), 7.5 to 8 inches in width (ends), and with two 3 inch "cropped corners" (i.e., the edge created when corners are removed or cropped) along one lateral side, thus forming a six sided polygon.

An inventive gaiter device 2 may be suitably altered in size to fit a smaller wearer, but with device proportions generally the same. In any case, the material thickness of LoopTex® material, at about 0.75 mm, is found to afford easy elastic extension and stable gripping and memory effects when stretched to 125-140% its initial length. A "male" or "hook" VELCRO® hook and loop fastener strip, about 1 and ⅜ inch wide is sewn onto the skin (or rubbery) side of the LoopTex® material directly adjacent one end depending on whether a "right" or "left" gaiter device is being fabricated.

Of course, a thicker backing could be employed with some advantage in terms of protection, but the heavier layers may result in loss of walking agility and comfort, and may be more difficult to apply to the shoe or boot. In any case, while a great variety of material equivalents exist, the material described is found highly beneficial in terms of performance in ankle joint support and impact absorption as well as impermeability and debris resistance.

The fabric unbroken or closed loop (i.e., "female" connectors) material 16 are, of course, highly suited to use in a hook and loop fastener arrangement such as the well known VELCRO® fasteners featured in the present invention. It is important that the present invention be universally adjustable with minimal limitations as to location of fastener 18. When in its working position about boot or shoe 8, the gaiter 2 will attach to itself only and does so through means of fastener 18 engaging at any desired location with closed loops of layer 16. The inventive gaiter device 2 thus is self-supporting and essentially automatically attached in that it does not require external fasteners in the form of elements affixed to or integral with the footwear to be covered thereby.

While the present invention is a welcome accessory to almost any footwear including popular forms of running gear, the gaiter 2 in the example illustrated herein is configured for rugged boots often worn by outdoor workers engaged in building or highway construction. Such workers often spend their days wading through loose stones, soil, mud, water, and snow. This challenging environment requires that workers take frequent breaks to remove their boots so as to empty out the intruding matter or to recover from turned or impacted ankles that commonly occur with uneven ground or shifting terrain. This downtime is counterproductive and costly.

The present invention results in a warm and comfortable, yet firmly supportive barrier against intrusion of foreign matter into the interior space of wearer's boot. More importantly, the double wrap of durable, elastically stretchable material protects against impact from rocks and such.

The present invention also firmly secures delicate bone components of the wearer's ankle and associated foot parts in place to aid wearer in avoiding ligament-stretching hyperflexion. In this unfortunate situation, the ligaments are stretched beyond their limits and the un-braced ankle rolls over into an unnatural and painful position. This is a frequent occurrence for runners and construction workers alike as they traverse uneven ground, rocky areas, or sandy surfaces. The traction qualities of gaiter device 2 inner surface and its firm binding by panel 18 will cause it to remain in place for long periods of time without slippage (or upward creep) away from the critical boot rim 9 zone, and without slowly unwrapping.

Advantaged by the present invention, workers and sports enthusiasts alike can confront rugged terrain with confidence that their feet will not suffer from invading stones, grit, pebbles sand and water. Their ankles will be substantially protected against impacts and braced against turning or strain. At any point in time, the gaiter device 2 easily can be removed with a single tug to disconnect strip 18. The pair of gaiter devices (shown as 2R and 2L) is readily stowed away in a pocket or glove compartment, where it remains convenient for future retrieval and quick application. When soiled, the gaiter device 2 material can be machine washed or simply hosed off, and will last for a remarkably long period of time.

Although various embodiments of the present invention have been described in the foregoing detailed description an illustrated in the accompanying drawings, it will be understood that the invention is not limited to the embodiments disclosed, but may assume numerous arrangements, rearrangements, modifications, and substitutions of elements and steps without departing from the spirit of the invention nor from the scope of the following claims.

I claim:

1. A footwear and ankle wrap device configured for tightly encircling a wearer's ankle and upper rim of said footwear so as to both brace the ankle and block ingress of debris into said footwear, said wrap device comprising:

an elongated article constructed of layers including a closed loop layer fabric to which is affixed a generally coextensive rubbery layer material that is both flexible and elastic so as to be pulled from an un-stretched condition to a stretched condition;

said elongated article being generally rectangular in shape with a first and second end edge defining a width of said device;

said first and second end edges spaced apart by first and, second elongated side edges defining a length of said device wherein said elongated side edges are longer than said end edges;

at intersections of said first and second end edges with said second elongated side edge, said article is truncated so as to form diagonally cropped corners of said generally rectangular article;

on said rubbery layer material and along said elongated article first end, a hook fastener element is affixed;

whereby said elongated article may be pulled by its first and second ends about said footwear upper rim, and manually stretched to wrap tightly in a double smooth edged layer about said footwear rim and ankle, and fastened by said hook fastener into place said closed loop fabric layer to thereby block ingress of debris and simultaneously brace wearer's ankle against turnover and sprains; wherein said hook fastener element associated with said rubbery material comprises the sole attachment for said elongated article—to better define over the prior art of record.

2. The footwear wrap device of claim 1 wherein said rubbery layer material is comprised of synthetic rubber based on polychloroprene directly foamed onto said closed loop fabric layer.

3. The footwear wrap device of claim 2 wherein said foamed synthetic rubber has a thickness in the range of 0.5 mm to 3.5 mm.

4. The footwear wrap device of claim 1 wherein said hook fastener element comprises a strip of male hook elements configured to attach to said closed loop fabric layer.

5. The footwear wrap device of claim 1 wherein each of said cropped corners, in its un-stretched condition, forms an obtuse angle with respect to the second elongated side edge and, in its stretched and fastened condition, is substantially aligned with said second elongated edge to form a relatively smooth continuous edge when applied to said footwear.

6. The footwear wrap device of claim 1 wherein said elongated article is flexible and elastic to be stretched to an extent which is 125% to 140% of its unstretched condition.

* * * * *